United States Patent [19]

Takano et al.

[11] Patent Number: 4,817,569

[45] Date of Patent: Apr. 4, 1989

[54] SINGLE OR TWIN VALVE TYPE FUEL INJECTION SYSTEM

[75] Inventors: Yoshiya Takano, Katsuta; Yoshikazu Hoshi, Toukai, both of Japan

[73] Assignee: Hitachi, Ltd., Tokyo, Japan

[21] Appl. No.: 901,372

[22] Filed: Aug. 28, 1986

[30] Foreign Application Priority Data

Aug. 28, 1985 [JP] Japan ..... 60-189014

[51] Int. Cl.[4] ..... F02M 61/14

[52] U.S. Cl. ..... 123/470

[58] Field of Search ..... 123/470, 472, 52 M, 123/52 MV

[56] References Cited

U.S. PATENT DOCUMENTS

| | | | |
|---|---|---|---|
| 2,808,041 | 12/1954 | Dolza | 123/52 MV |
| 3,109,416 | 11/1963 | Roze et al. | 123/52 MV |
| 4,013,049 | 3/1977 | Dilgard et al. | 123/52 MV |
| 4,105,004 | 8/1978 | Asai et al. | 123/470 |
| 4,149,496 | 4/1979 | Palma | 123/472 X |
| 4,237,836 | 12/1980 | Tanasawa et al. | 123/472 |
| 4,250,842 | 2/1981 | Sutton | 123/472 |
| 4,313,411 | 2/1982 | Moriyama et al. | 123/470 X |
| 4,354,470 | 10/1982 | Miyaki et al. | 123/472 |
| 4,372,271 | 2/1983 | Elpern et al. | 123/472 X |
| 4,457,281 | 7/1984 | Ueyama et al. | 123/472 X |
| 4,557,241 | 12/1985 | Kawachi et al. | 123/472 X |

FOREIGN PATENT DOCUMENTS

| | | | |
|---|---|---|---|
| 0041452 | 4/1981 | Japan | 123/472 |

*Primary Examiner*—Tony M. Argenbright
*Assistant Examiner*—Eric R. Carlberg
*Attorney, Agent, or Firm*—Antonelli, Terry & Wands

[57] ABSTRACT

A single or twin valve fuel injection system including a fuel injection valve disposed on a downstream side of a throttle valve. The fuel injection system includes one or two barrels which are separated on a downstream side of the throttle valve and, each of which contains a fuel injection valve. The air intake passage is provided with a bent or curved passage member between a throttle valve and the barrel so that the streamline of the intake air passing through the throttle valve is turned at an angle of 90° prior to flowing into the one or two barrels.

14 Claims, 6 Drawing Sheets

SINGLE OR TWIN VALVE TYPE FUEL INJECTION SYSTEM

BACKGROUND OF THE INVENTION

The present invention relates to a fuel injection system for an engine of a motor vehicle and, in particular, a fuel injection system which includes a single or twin valve type fuel injection arrangement in which the respective intake manifold of the cylinders of the engine are integrated and a fuel injection valve is installed at the point of integration for supplying the fuel.

A single valve type fuel injection system for a motor vehicle engine is a system wherein one fuel injection valve is provided at a branching position of an intake manifold so as to timely supply fuel to each cylinder of the engine. An advantage of a single valve type fuel injection system resides in the fact that it enables a reduction of the number of fuel injection valves required; however, a disadvantage of the single valve type fuel injection system resides in the fact that it is extremely difficult to provide a uniform air stream in the manifold as the number of cylinders increase. Consequently, there is a deterioration in the distribution characteristics of the fuel supplied to each cylinder.

Various proposals have been made to improve the distribution characteristics of the fuel supply and, for example, in Japanese Patent Publication No. 11211/1895, a plurality of cylinders are grouped into odd numbered cylinders and even numbered cylinders, with an intake manifold of each cylinder group being provided with a throttle valve and a fuel injection valve so as to improve the distribution characteristic of the fuel injection valve system.

It has also been determined that a deterioration of the distribution characteristics of the fuel supplied in a single or twin valve type fuel injection system is caused not only by the increase in the number of cylinders of the engine but also by turbulence in the intake air due to a change in velocity occurring when the air passes through the throttle valve and, consequently, to avoid any adverse effects, it is necessary to take measures so as to improve the conditions of the intake air.

The aim underlying the present invention essentially resides in providing a single or twin type fuel injection system which improves the distribution characteristics of the fuel mixture supplied to each cylinder by a method in which the turbulence of an intake air stream, occurring when the stream passes through the throttle valve, is eliminated by regulating the air stream.

More particularly, in accordance with advantageous features of the present invention, an intake manifold of an internal combustion engine having a plurality of cylinders performing the same stroke without overlapping is provided with a fuel injection valve which is positioned on an upstream side of a branching position of the intake manifold and which is adapted to supply fuel to each cylinder. A throttle valve is disposed in an intake air passage on an upstream side of the fuel injection valve with a bent or curved passage member being provided for regulating intake air passing through the air intake passage. The bent or curved member is disposed between the throttle valve and the injection body which accommodates the fuel injection valve so as to improve the air-fuel mixture distribution characteristics of the fuel injection system.

In accordance with the present invention, the intake air stream, when it becomes turbulent as it passes through the throttle valve, is regulated by the bent or curved passage member on the downstream side of the throttle valve and then flows into the injection body. The intake air is mixed therein with the injected fuel to be formed into an appropriate mixture, and the uniform mixture is then distributed and supplied alternately and sequentially to each cylinder by virtue of the regulation effects of the bent or curved passage member.

In accordance with further features of the present invention, the bent or curved passage member is positioned in such a manner that the inner wall surface of said bent or curved passage member which is located at the side of a bending portion having the smallest radius of curvature and the inner wall portion of said bent or curved passage member which is located at the side of the bending portion having the largest radius of curvature are respectively opposed to a portion of said throttle valve which is located on the upstream side and a portion of said throttle valve which is located on the downstream side.

Additionally, in accordance with still further features of the present invention, the single or twin valve type fuel injection system of the present invention is provided with two separate barrels on a downstream side of the throttle valve, with each of the barrels containing or accommodating a fuel injection valve.

Advantageously, the curved passage member includes a skirt means and an outlet thereof which is arranged in such a manner so as to cover the two barrels.

The bent or curved passage member of the present invention is constructed whereby the steamline of air passing through the intake air passage is bent by an angle of 90°.

These and other objects, features, and advantages of the present invention will become more apparent from the following description when taken in connection with the accompanying drawings which show, for the purposes of illustration only, several embodiments in accordance with the present invention.

DETAILED DESCRIPTION

Figure 1:
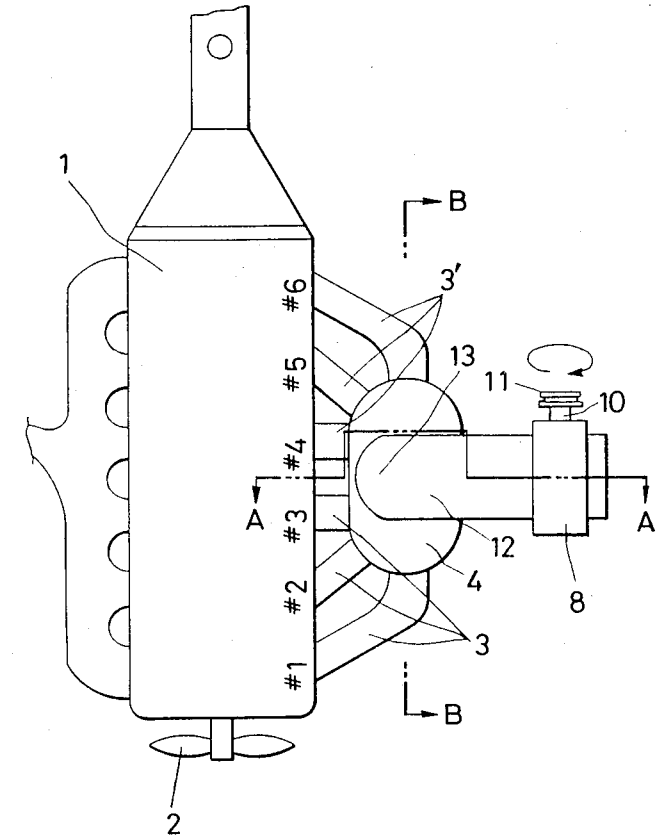
FIG. 1 is a plan view of a first embodiment of a fuel injection system constructed in accordance with the present invention.
Figure 4:
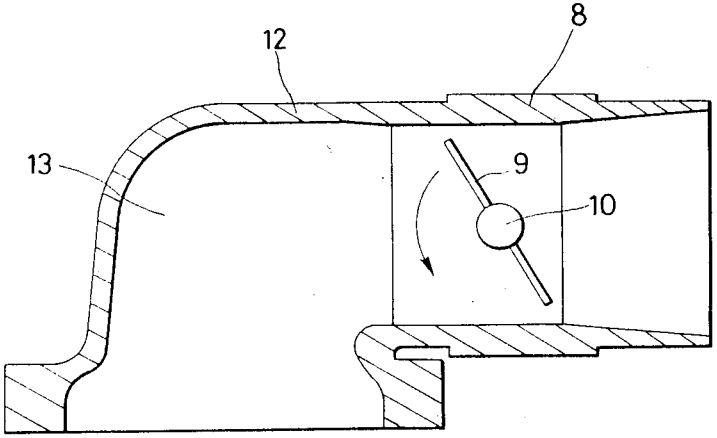
FIG. 4 is a cross-sectional view of a portion of the fuel injection system of FIG. 1.

Referring now to the drawings wherein like reference numerals are used throughout the various views to designate like parts and, more particularly, to FIG. 1, according to this figure, a motor vehicle engine 1 having, for example, six cylinders, includes a cooling fan 2, with the first to sixth cylinders numbered from the cooling fan side being provided with fitting devices designated #1–#6. The engine 1 includes intake manifolds 3, 3' with the first to third cylinders being integrated or joined by the intake manifold 3, while the fourth to sixth cylinders are integrated or joined by the manifold 3'. As shown most clearly in FIG. 3, the intake manifolds 3, 3' are connected on a side branching position 3*a* to an injection body 4 vertically positioned thereon.

The cylinders of the six cylinder engine 1 perform intake strokes in the following sequence #1, #5, #3, #6, #2, and #4, with the cylinders being set so that those belonging to the first cylinder group comprising cylinders #1 to #3 and those belonging to the second group comprising cylinders #4 to #6 alternately conduct an air drawing operation. Moreover, the cylinders of the first cylinder group are set so that the fuel injection is started at a crank rotation angle of 0°, 120° and 240°, respectively, while those of the second cylinder group are set so that the injection is started at crank rotation angles of 360°, 480°, and 600°, respectively.

Figure 3:
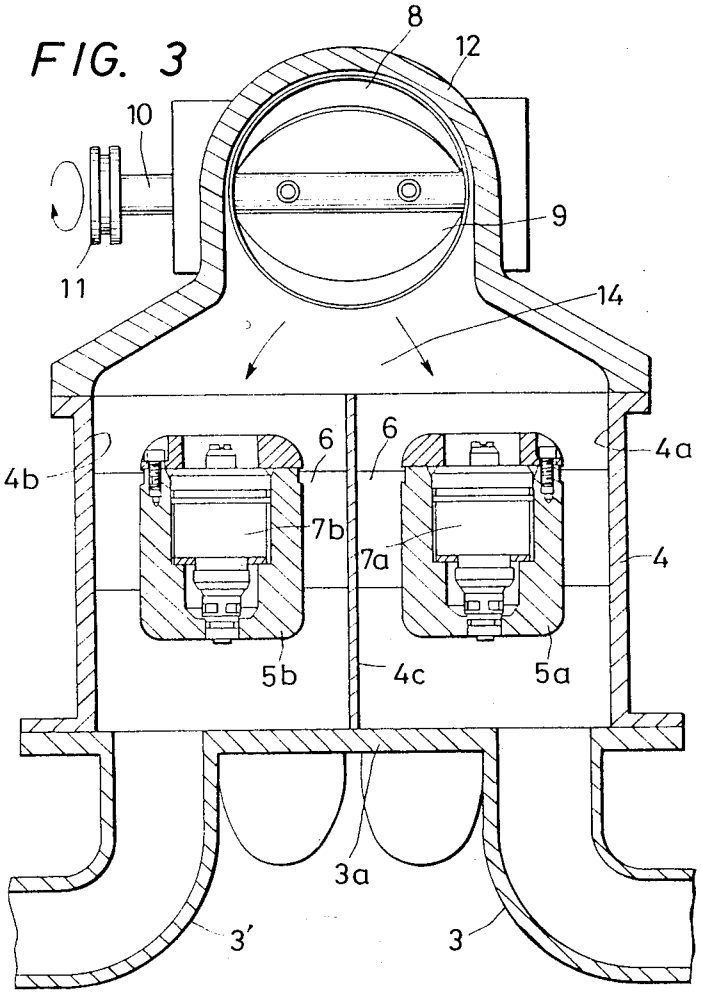
FIG. 3 is a cross-sectional view taken along the line B—B in FIG. 1.

As shown in FIG. 3, injection body 4 includes two independent barrels 4*a*, 4*b* separated from each other by a partition wall 4*c*. The pipes of the intake manifold 3, on a side of the barrel 4*a*, are arranged at substantially equal intervals along concentric circles around a fuel injection valve 7*a* and, on the side of the barrel 4*b*, the pipes of the intake manifold 3' are also arranged at substantially equal intervals on concentric circles around a fuel injection valve 7*b*. Holders 5*a*, 5*b* are respectively fixedly arranged in a central portion of the barrels 4*a*, 4*b* by way of arm 6 with the fuel injection valves 7*a*, 7*b* being respectively accommodated in the holders 5*a*, 5*b*. These elements are so constructed that the fuel injection valves 7*a*, 7*b* are supplied with fuel for fuel injection through the arm 6.

An intake control valve element 8 is provided on an upstream side of the injection body 4. A throttle valve for controlling the quantity of intake air is rotatably disposed inside the intake control valve element 8. A valve shaft 10, supporting the throttle valve 9, extends outside of the element 8, and a hook or actuating means 11 is provided at the end of the valve shaft 10. The opening of the throttle valve 9 is increased and decreased in conjunction with the state of the operation of the six-cylinder engine 1, and the opening and closing operation of the throttle valve 9 and is controlled or executed by virtue of an operation of an accelerator by an operator of the motor vehicle.

Figure 2:
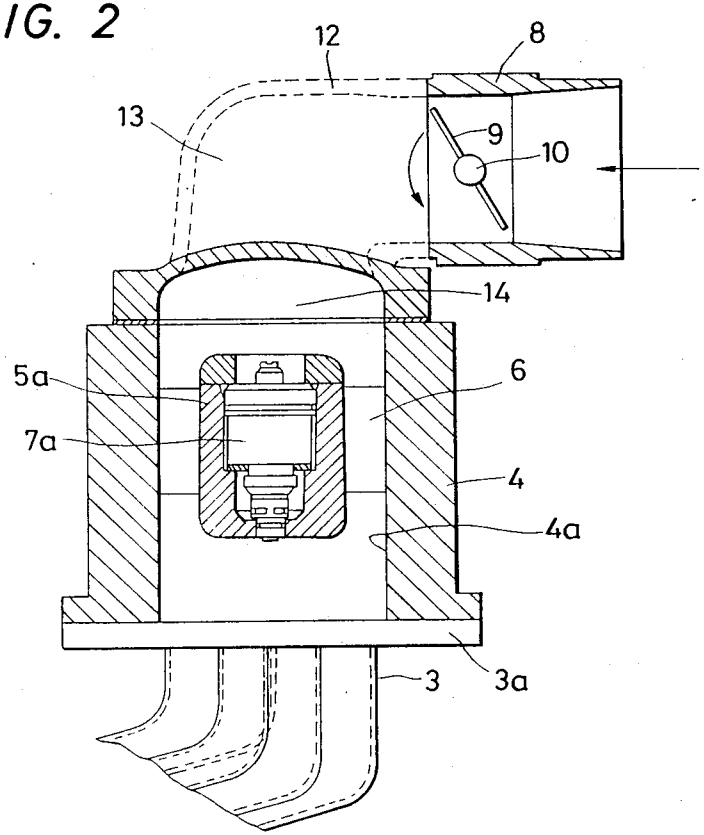
FIG. 2 is a cross-sectional view taken along the line A—A in FIG. 1.

Air intake passage 12 connects the intake control valve element 8 with the injection body 4. A bent or curved passage member 13 is provided in the air intake passage 12 whereby the intake air passage 12 is mounted, on a lower end side thereof at a position 14 where the barrels 4*a*, 4*b* branch from each other inside the injection body 4. In the embodiment of FIGS. 1–3, the member 13 is constructed as an elbow formed by bending the intake air passage 12 at an angle of 90.

The process of the formation of air-fuel mixture in the embodiment FIG. 1 will now be described in the comparison with that of the prior art.

As shown in FIGS. 2 and 3, the quantity or volume of air flowing into the intake control valve element 8 is controlled by an opening of the throttle valve 9 at that time and flows onto the downstream side of the throttle valve 9. Since the integrated cylinders in each of the barrels 4*a*, 4*b* conduct an operation, namely, an intake stroke, alternately on the downstream side of the throttle valve 9, the intake air flows alternately in the direction of the arrows shown in FIG. 3, while a necessary quantity of fuel, corresponding to the quantity of intake air, is injected at a prescribed timing from each of the injection valves 7*a*, 7*b* into each of the barrels 4*a*, 4*b* so as to form the air-fuel mixture.

In the above-described process of forming the air-fuel mixture, the velocity of the intake air passing through the throttle valve 9 increases sharply by virtue of the restriction of the area of the passage, and turbulence occurs in the air flow due to the sharp change in velocity. In this situation, when the throttle valve 9 and the injection body 4 with barrels 4*a*, 4*b* are connected together through the intermediary of a straight pipe as in the prior art, the intake air flows, with the turbulence remaining therein, into the injection body 4 and therefore the distribution of air flow in the two directions of the barrels 4*a*, 4*b* becomes unbalanced. Consequently, a relatively large non-uniformity results in the formation of the air-fuel mixture of the intake air and injected fuel in each of the barrels 4*a*, 4*b* thereby rendering it impossible to supply a uniform air-fuel mixture to each of the cylinders of the engine. In contra-distinction to the above-noted difficulties with regard to the prior art, in accordance with the above-described embodiment, the intake air is regulated prior to flowing into the barrels 4*a*, 4*b* by the member 13 which is provided in the intake air passage 12 connecting the throttle valve 9 and the injection body 4. In other words, the intake air, the velocity of which is not in a fixed direction when it passes through the throttle valve 9, is turned in such a direction that the streamlines of the stream of air flow are all directed toward the injection body 4 when it passes through the bent or curved passage member 13. Thus, the streamlines of the entire mass of intake air are regulated to be in a fixed direction. Therefore, the intake air is alternately and uniformly distributed to each of the barrels 4*a*, 4*b* provided on the downstream side of the throttle valve 9 in correspondence to the intake stroke of each of the cylinders. Consequently, an appropriate air-fuel mixture can be formed in each of the barrels 4*a*, 4*b*, which appropriate mixture can be distributed in a substantially uniform state to each cylinder of the engine.

FIGS. 5*a*–5*g* and FIGS. 6*a*–6*b* graphically illustrate the test results of distribution characteristics of the above-described embodiment applied to a six cylinder engine as compared with that of a prior art twin valve type fuel injection system of the same type in which a straight passage having no bent or curved passage member is utilized. In the tests to establish the distribution characteristics illustrated in the above-noted figures, an elbow having a curve of 90°, and a curvature of 57.2 mm and an inside diameter 46 mm were employed as the intake air passage 12 of the construction described hereinabove in accordance with the present invention.

Figure 5:
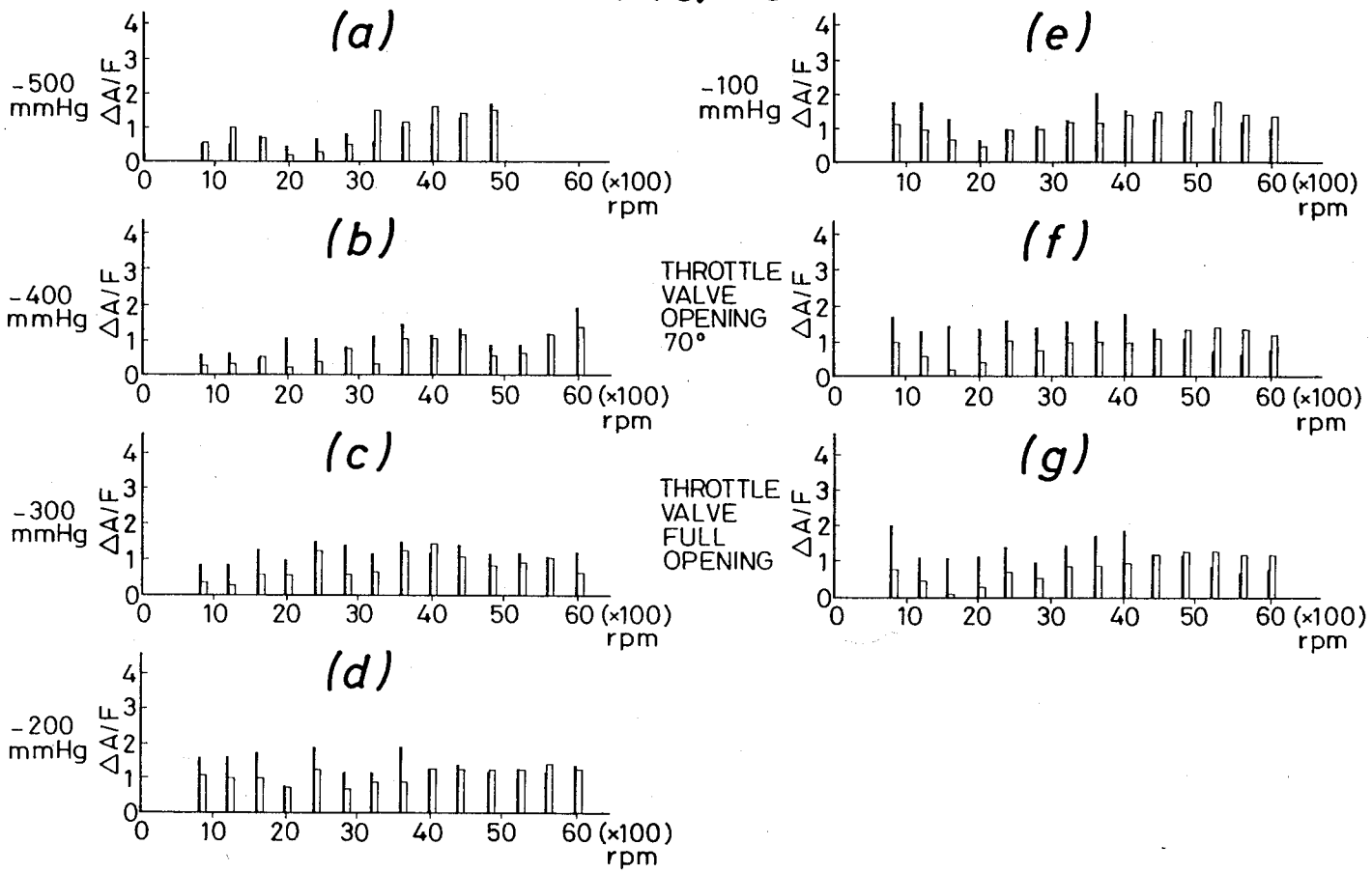
FIGS. 5(*a*)–(*g*) are graphical illustrations comparing the fuel distribution characteristics of the fuel injection system of the present invention with that of a prior art system.
Figure 6A:
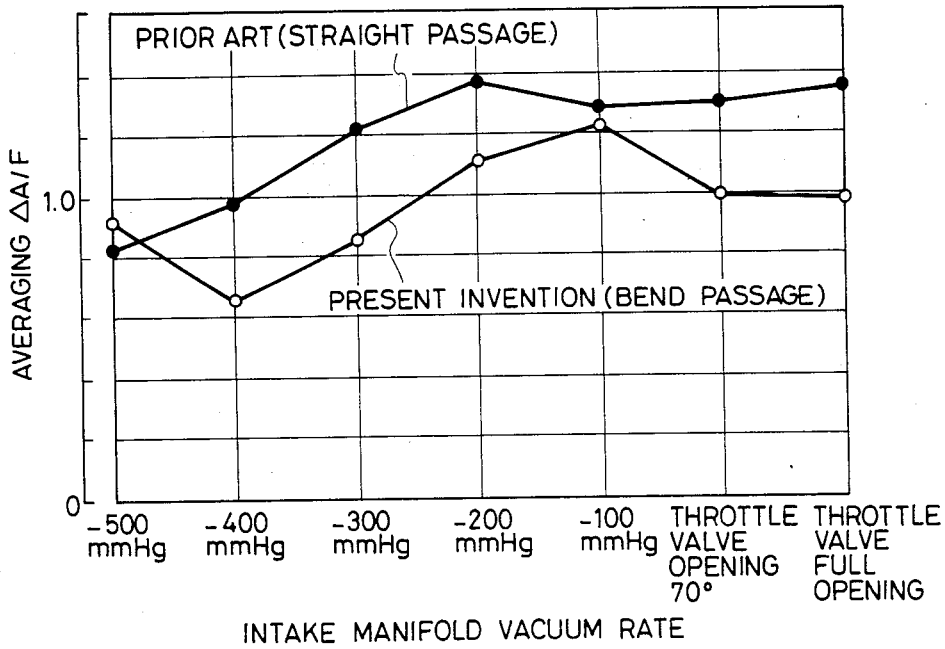
FIGS. 6(*a*) and 6(*b*) are graphical illustrations of distribution characteristics formed by graphing average valves shown in FIGS. 5(*a*)–(*g*)
Figure 6B:
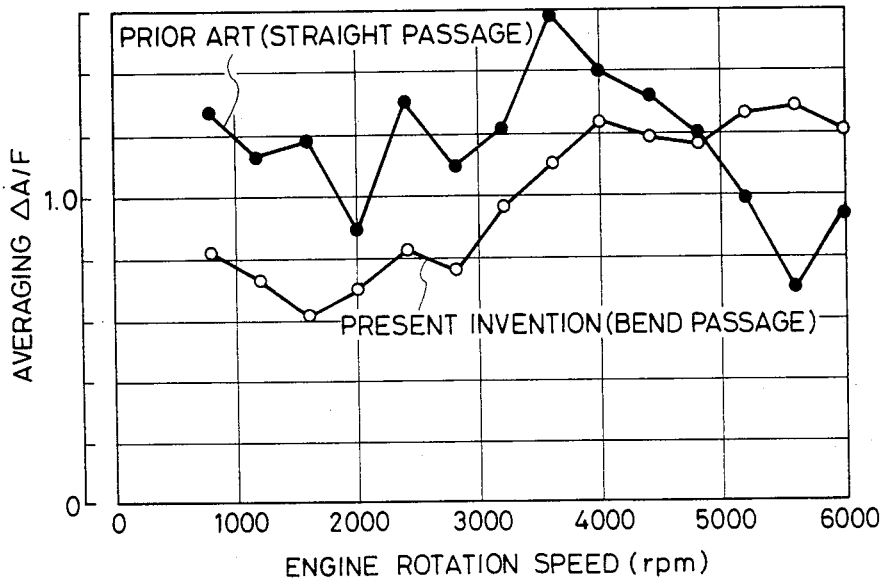

FIGS. 5(*a*)–(*g*) illustrate a comparison between the prior-art example, represented by the black bar graphs, and the above-described embodiment of the present invention, represented by the white bar graphs, with respect to the maximum air-fuel (A/F) difference between the first-sixth cylinders at the time of each load operation at every 400 rpm in the range of 800 rpm to 6,000 rpm during the occurrence of each intake pipe negative pressure, −500 mm Hg to full opening of the throttle valve 9. In FIGS. 5(*a*)–5(*g*) and FIGS. 6(*a*)–6(*b*) the ordinate of the graphical illustrations is represented by ΔA/F and the abscissa represents the load operation of the engine as determined by the engine rpm.

FIG. 6(*a*) represents a graphical illustration of average values obtained by averaging the ΔA/F valves from 800 to 6,000 rpm of FIGS. 5(*a*)–5(*g*) for each intake pipe negative pressure. According to the above-described embodiment, as shown in FIG. 6(*a*) and FIGS. 5(*a*)–5(*g*), all the average values ΔA/F have been successfully reduced or made smaller in each state of the intake negative pressure except for −500 mm Hg than those in the prior art. In other words, the supply of fuel to separate cylinders has been made more uniform by virtue of the above-described embodiment than the prior art, thereby enabling improvement in the distribution characteristic of the air-fuel mixture.

FIG. 6(*b*) is a graphical illustration of the average values obtained by averaging the values of ΔA/F of FIGS. 5(*a*)–5(*g*) summed or totalled for each load or number of rotations of the engine. As shown in FIG. 6(*b*), the above-described embodiment of the present invention enables a remarkable improvement in the distribution characteristics of the air-fuel mixture at 4,800 rpm or below in comparison with the prior art constructions.

The bent or curved passage member for air regulation of the present invention adapted to a fuel injection system of a two barrel type produces the same effect as in the fuel injection system of a one-barrel type described more fully hereinbelow.

Figure 8:
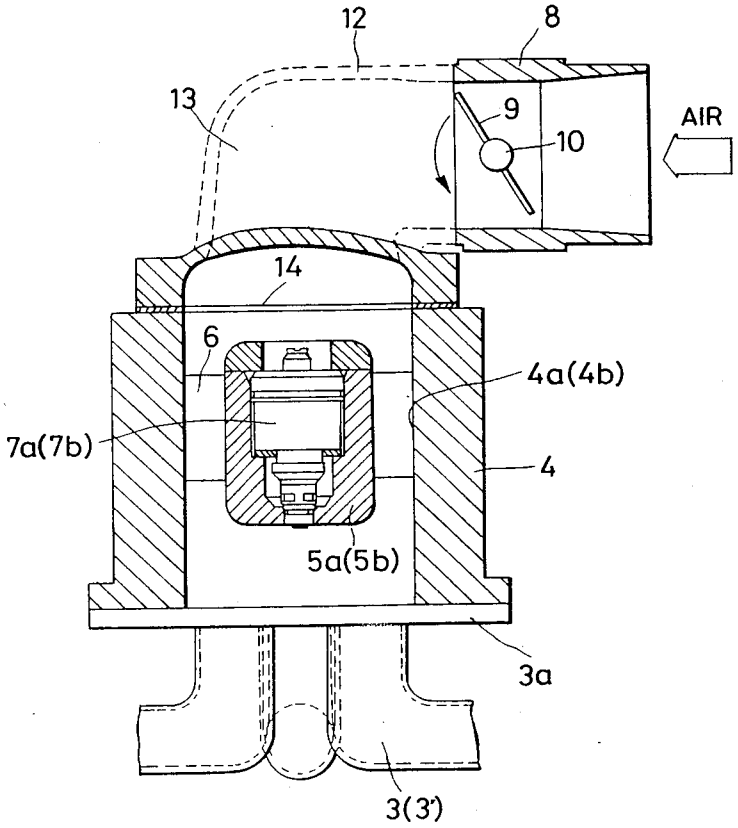
FIG. 8 is a cross-sectional view taken along the line C—C in FIG. 7.
Figure 7:
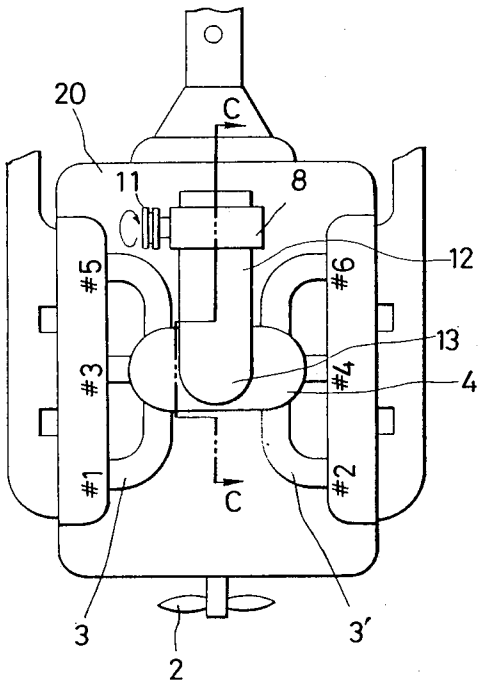
FIG. 7 is a plan view of another embodiment of the present invention.

FIGS. 7 and 8 provide an example of the subject matter of the present invention applied to a V-6 cylinder engine 20, with strokes of the 6-cylinder engine being designated #1, #2, #3, #4, #5, and #6. Consequently, the cylinders #1, #3, and #5 correspond to the barrel 4*a* and the cylinders #2, #4, and #6 to the barrel 4*b*. In all other respects, the fuel injection system of FIGS. 7 and 8 correspond to the first described embodiment. According to the fuel injection system of FIGS. 7 and 8, it is possible to achieve a regulation of the intake air and improve the distribution of an air flow to the barrels 4*a* and 4*b* as well as to improve the formation of an air-fuel mixture.

Figure 10:
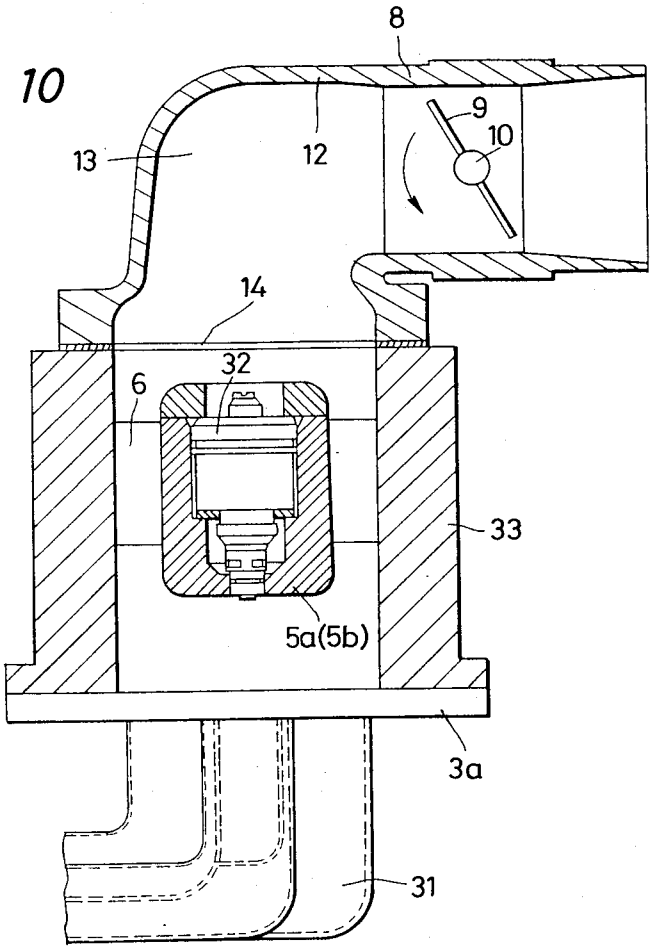
FIG. 10 is a cross-sectional view taken along the line D—D in FIG. 9.
Figure 9:
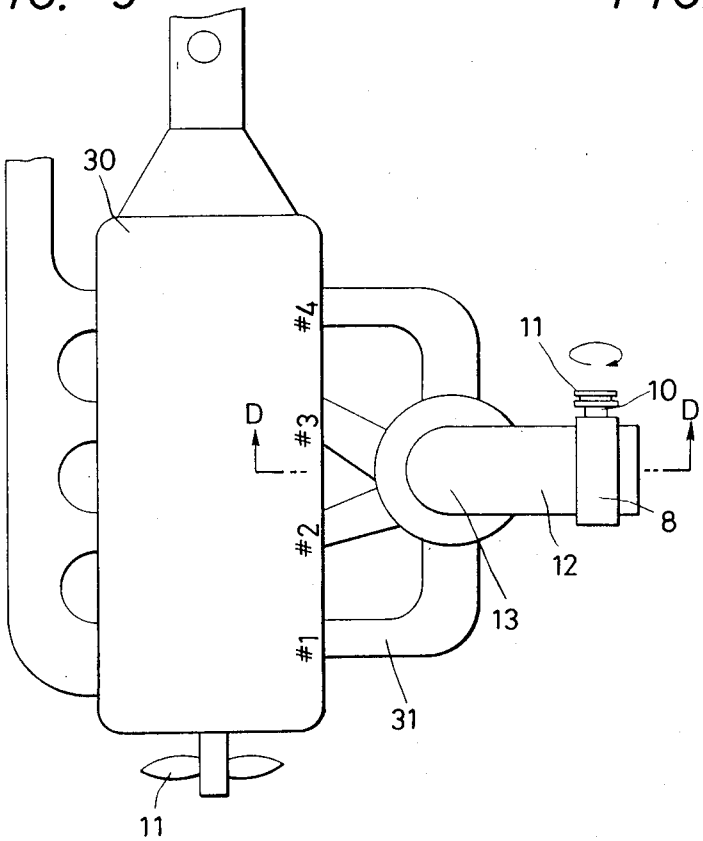
FIG. 9 is a plan view of a third embodiment of a fuel injection system constructed in accordance with the present invention.

FIGS. 9 and 10 provide an example of the adaptation of the subject matter of the present invention as applied to a four cylinder engine 30. In a four cylinder engine, since each cylinder operates at an interval of a crank angle of 180°, there is no overlapping portion in the intake stroke of the cylinders and, consequently, all of the cylinders can be integrated or joined into a single barrel. Moreover, since the cylinders operate in the sequence of #1, #3, #4, and #2, they may be integrated or joined by an intake manifold 31 in such a manner that they are arranged in the sequence of #1, #3, #4 and #2 in a clockwise or counterclockwise direction around a fuel injection valve 32. Since a one barrel system is utilized in the embodiment of FIGS. 9 and 10, such a branching point of the two barrels 4*a*, 4*b* described in connection with the foregoing embodiments does not exist inside the injection body 33; however, by regulating intake air on the downstream side of the throttle valve 9 by the provision of the bent or curved passage member 13, a fuel-air mixture can be distributed and uniformly supplied to each cylinder whereby the distribution characteristics of the fuel-air mixture can be improved.

By virtue of the advantageous features of the present invention as described above, the turbulence of the stream of intake air occurring when the air passes through the throttle valve 9 can be eliminated by regulation so as to form an appropriate air-fuel mixture and the fuel-air mixture distribution characteristics can be improved so as to ensure a sequential distribution and supply of a uniform air-fuel mixture to each cylinder of the engine.

We claim:

1. A fuel injection system for an internal combustion engine having intake air passage means for supplying intake air, a plurality of cylinder means making a same stroke without overlapping and intake manifold means having a branching position for supplying intake air from said intake air passage means into the respective cylinder means, the fuel injection system, comprising:

fuel injection valve means disposed within said intake air passage means at an upstream side of said branching position of said intake manifold means for supplying fuel to each of said cylinder means, throttle valve means disposed in a throttle body means forming part of said intake air passage means of the engine at a position upstream of said fuel injection valve means, and means formed in said intake air passage means between said throttle valve means and said fuel injection valve means for regulating a flow of intake air passing therethrough between the throttle valve means and said fuel injection valve means, wherein said means for regulating includes an unobstructed curved passage means which is integrally formed with said throttle body means supporting the throttle valve means which is configured to direct the lines of flow of said intake air in a fixed direction toward said fuel injection valve means.

2. A fuel injection system according to claim 1, wherein in the fuel injection system is a single valve fuel injection system.

3. A fuel injection system according to claim 2, wherein means are provided for suspending the fuel injection valve means in a center area of an injection body means through which air flows from said intake air passage means.

4. A fuel injection system according to claim 1, wherein said curved passage means is disposed downstream of the throttle valve means and is configured to bend a streamline of air in the air intake passage means substantially at a right angle.

5. A fuel injection system according to claim 4, wherein said curved passage means is arranged such that an inner wall surface of said curved passage means disposed at a side of a bending portion of said curved passage means having the smallest curvature and an inner wall surface of said curved passage means disposed at a side of the bending portion of said curved passage means having the largest curvature are respectively opposed to a portion of said throttle valve means located on an upstream side and a portion of said throttle valve means located on a downstream side thereof.

6. A fuel injection system according to claim 1, wherein the fuel injection valve means is supported in throttle body means which includes two separate barrels, and wherein fuel injection valve means are disposed in each of said barrels.

7. A fuel injection system according to claim 6, wherein said curved passage means is configured to bend a streamline of air in the air intake passage means substantially at an angle of 90°.

8. A fuel injection system according to claim 1, wherein the fuel injection system is a twin valve fuel injection system.

9. A fuel injection system according to claim 8, wherein means are provided for suspending the fuel injection valve means in a center area of an injection body means through which air flows from said intake air passage means.

10. A fuel injection system according to claim 9, wherein said means for regulating includes a curved passage means integrally formed with a throttle body means supporting the throttle valve means.

11. A fuel injection system according to claim 10, wherein said curved passage means is disposed downstream of the throttle valve means and is adapted to bend a streamline of air in the air intake passage means substantially at a right angle.

12. A fuel injection system according to claim 11, wherein said curved passage means is arranged such that an inner wall surface of said curved passage means disposed at a side of a bending portion of said curved passage means having the smallest curvature and an inner wall surface of said curved passage means disposed at a side of the bending portion of said curved passage means having the largest curvature are respectively opposed to a portion of said throttle valve means located on an upstream side and a portion of said throttle valve means located on a downstream side thereof.

13. A fuel injection system according to claim 8, wherein the throttle body means includes two separate barrels, and wherein fuel injection valve means are disposed in each of said barrels.

14. A fuel injection system according to claim 13, wherein said curved passage means is adapted to bend a streamline of air in the air intake passage means substantially at an angle of 90°.

* * * * *